US005255730A

United States Patent [19]

Wall

[11] Patent Number: 5,255,730

[45] Date of Patent: Oct. 26, 1993

[54] PROCESS FOR PRODUCING A CASTING CONSISTING OF A PRIMARY PIECE AND A SECONDARY PIECE USING THE CASTING-ON TECHNIQUE AND A CERAMIC INSULATING COMPOUND SUITABLE FOR THIS

[76] Inventor: Giselher Wall, Ludwigstrasse 18, D-8730 Bad Kissingen, Fed. Rep. of Germany

[21] Appl. No.: 743,349

[22] PCT Filed: Feb. 6, 1990

[86] PCT No.: PCT/DE90/00077

§ 371 Date: Oct. 1, 1991

§ 102(e) Date: Oct. 1, 1991

[87] PCT Pub. No.: WO90/08609

PCT Pub. Date: Aug. 9, 1990

[30] Foreign Application Priority Data

Feb. 6, 1989 [DE] Fed. Rep. of Germany ..... 3903427
Jan. 16, 1990 [DE] Fed. Rep. of Germany ..... 4001057

[51] Int. Cl.[5] ..... B22D 19/04; B22D 19/14

[52] U.S. Cl. ..... 164/100; 164/97

[58] Field of Search ..... 164/9, 100, 101, 102, 164/DIG. 4, DIG. 15, 131

[56] References Cited

U.S. PATENT DOCUMENTS 3,899,324 8/1975 Corbett ..... 164/473
4,060,120 11/1977 Takahashi et al. ..... 164/DIG. 4
4,703,806 11/1987 Lassow et al. ..... 164/518

*Primary Examiner*—Mark Rosenbaum
*Assistant Examiner*—Erik R. Puknys
*Attorney, Agent, or Firm*—Cushman, Darby & Cushman

[57] ABSTRACT

In the production of cast fittings by the precision casting process of the casting-on technique, primary and secondary pieces can be easily separated from one another if the primary piece surface is isolated with a ceramic interlayer being chemically not attackable by the constituents of the alloys used. An interlayer containing zirconium dioxide is especially preferred.

25 Claims, No Drawings

PROCESS FOR PRODUCING A CASTING CONSISTING OF A PRIMARY PIECE AND A SECONDARY PIECE USING THE CASTING-ON TECHNIQUE AND A CERAMIC INSULATING COMPOUND SUITABLE FOR THIS

The invention relates to a process for producing a casting consisting of a primary piece and a secondary piece using the casting-on technique. With the casting-on technique, a special kind of precision casting, a second metallic body (secondary piece) is cast onto the first metallic body (primary piece) with great accuracy in the production of cast fittings. The primary piece can be cast too, and the secondary piece fits to it. Such fittings find application in the field of dental technology in the production of tooth replacement anchors, such as attachments and double crowns. The casting-on technique can however in other areas of precision mechanics also rationalize expensive deformation and adjustment work in the production of fittings, such as for example in the casting-in of complicated movements in paste jewellery which are not accessible to pinning, or very generally in the casting-in of all those space maintainers in precision casting technology which are later to be removed.

The traditional process used in the production of cast fittings consists of preparing from the primary piece which was made first a duplicate pattern which is resistant to the casting effects of the subsequent secondary casting, and of casting onto this, within a mould, the secondary melt.

However with this indirect procedure, especially in the case of high-melting alloys with a high surface melting loss, disturbing variations have to be tolerated, even when there is an optimal harmony of the expansion and contraction behaviour of the casting mould and the cast metal. Even with noble metal casting or the working, in the vacuum casting process, of cast metals threatened by the formation of oxides or nitrides, this indirect method of producing a cast fitting will still always produce a disturbing, methodically conditioned variation even when modern controllable mounting materials are used for the precision casting.

It was therefore attempted to increase the precision of the fitting by the direct casting-on of one fitting partner onto the other. This technique of direct casting-on is termed the casting-on technique. One difficulty of this technique lies in the fact that frequently the primary and secondary pieces during casting bond inseperably to one another. For this reason the primary piece and the secondary piece must be isolated from one another in order that they may be separated from one another after casting.

In the state of the art numerous methods of isolation have been developed for the casting-on technique, but they all possess considerable disadvantages. An attempt was made, for example, to restrain diffusion processes between the primary and secondary pieces by selecting different alloys for the primary and secondary pieces. However electrical potential differences arise between alloys which are greatly different from one another, and these can lead to destruction of the cast fitting by corrosion.

The provision beforehand of autogenous oxidic interlayers on the primary piece as well as on the surface of the molten secondary alloy leads often in practice to inadequate isolation. The reason for this can lie in the chemical reactions which take place when there is contact of the secondary alloy with the surface of the primary piece during casting-on at higher temperatures.

The provision beforehand of an exogenous interlayer which is applied mechanically using the PAC method (Precision Attachment Casting-On Technique) leads in the case of sheet structures to inadequate isolation, for example, with conical and telescopic crowns or with locks. The formation of a surface film which is high-temperature resistant and slightly soluble from a special ceramic mass by means of the CVD method leads to good results. However the high working temperatures involved in the CVD method restrict its applicability to alloys with solidus temperatures above ca. 1100° C.

The known application of colloidal graphite is limited to low-melting gold alloys and shows no constancy in its effect.

The known blowing of lycopodium (club foot moss spores) onto the primary piece with low-melting alloys can be rejected solely on account of the rarity of the club foot moss.

'Cold-casting', which continues to be proposed, where the working temperature of the casting mould is kept much lower than is usual, is only possible with a few alloys which show a flowability above the average. These frequently contain beryllium Whose use in Germany is forbidden for dental replacements on account of its toxicity.

The present invention sets as its basis the task of providing the surface of the primary piece with an interlayer as thin as possible and which is stable during casting.

This task is according to invention solved by a process of the present invention which provides a process for the production of a casting consisting of a primary piece and a secondary piece using the casting-on technique, which is characterized by a thin ceramic interlayer being formed on the surface of the primary piece which isolates against the metal melt of the secondary piece which is to be cast, and which is removed after the casting of the secondary piece and after the separation of the primary and the secondary pieces.

It is another object of the present invention to provide ceramic isolating compounds for the casting-on technique with the primary piece of high-melting dental casting alloy, characterized by being a suspension of zirconium dioxide powder in aqueous silica sol.

The present invention further provides ceramic isolating compounds for the casting-on technique with the primary piece of low-melting dental gold alloy, characterized by being a suspension of zirconium dioxide powder within each case 5% by weight of vanadium (V) oxide and lithium fluoride in aqueous silica sol.

In one preferred embodiment, the process of the present invention is characterized by a ceramic interlayer being formed from components of a ceramic compound which is applied to a cleaned primary piece and which is fired to a homogeneous coating at a temperature between 500° and 1200° C., preferably 700° to 1100° C., and particularly 800° to 1000° C., wherein the components of the ceramic compound may be suspended or dissolved in a liquid, particularly in water, before being applied to the cleaned primary piece.

In another preferred embodiment, the process of the present invention is further characterized by a coating possessing a thickness after firing of 1 to 50 μm, preferably 1 to 8 μm, particularly 2 to 5 μm, wherein the production of a dental prosthetic attachment anchor, in particular a conical or telescopic crown or a lock of dental alloy, in particular a gold alloy, is accomplished. The secondary piece being cast from a dental alloy whose liquidus point is as close as possible to or below the solidus point of the primary alloy.

In yet another embodiment, the process of the present invention is characterized by the ceramic interlayer being made of a compound which contains: (a) at least one alkaline-earth metal oxide, a rare earth metal oxide, aluminium oxide or a titanium group metal oxide; or, (b) at least one metal double oxide or a mixed oxide consisting of at least one metal oxide as well as one non-metallic oxide from the elements boron, phosphorus or silicon and/or one halogen, especially a fluorine compound, corresponding to the non-metallic oxide; or, either separately, or in addition to the above, the following may be used: (c) red iron (III) oxide at a concentration of 0.1–1.0% by weight; and/or (d) a nitride of one metal from the titanium metal, vanadium metal and chromium metal group or aluminium boron silicon nitride, pyrogenous silicon dioxide or silicon carbide. Alternatively, an interlayer of zirconium dioxide may be applied. Such a zirconium dioxide powder being suspended in water, sintering aids being added if need be, depending on working temperatures, and being applied to the surface of the primary piece. Further, the zirconium dioxide-silicic acid suspension is fired after drying onto the surface of the primary piece at a temperature of between 900° to 950° C. The process may be further characterized by 5% by weight lithium fluoride as flux agent and 5% by weight vanadium (V) oxide as a bonding and flux agent being added to the zirconium dioxide. The zirconium dioxide, lithium fluoride and vanadium (V) oxide may be suspended in aqueous silica sol, being applied to the surface of the primary piece, and, after drying, being fired at a temperature of 700° to 750° C.

The process according to the present invention is further characterized in that the compound is being made from: (3) 90–98% by weight high-melting particles with softening temperatures far beyond the sintering temperature of the compound; and also (f) approximately 2–10% by weight low-melting particles which soften below or at the sintering temperature and which can also show solubility in water without being hydroscopic; and/or (g) a sintering aid for the high-melting particles, namely, silicic acid as xerogel, boric oxide or phosphorus (V) oxide, these sintering agents being released from source compounds in situ during the firing process.

The process may be further characterized by components (a), (b) and/or (d), above, being used as high-melting particles.

In another embodiment, the process in accordance with the present invention further provides a double oxide or a mixed oxide as in (b), above, which is stoichiometrically defined and being a formal anhydrous salt of silicic phosphoric boric acid or a metallic acid or a formal mixed anhydride of different metallic acids, including halogen-free heteropoly acids and keggin acids of the auxiliary metal group, whereby at least one of the metallic central atoms in the compounds named and/or the formal cation is an alkaline-earth metal, a rare earth metal, aluminium or a titanium group metal.

In a further embodiment, the present invention relates to a process characterized by a component (b), as above, being used as a low-melting particle, which is stoichiometrically defined and corresponds formally to an anhydrous salt of silicic phosphoric boric acid or a metallic acid, including halogen-free heteropoly acids and keggin acids of the auxiliary metal group, whereby, within the formal anion, the oxygen can be replaced by a halogen, preferably fluorine, the formal cation, however, being exclusively an alkaline metal, in particular, potassium.

The sintering aids as in (g), above, may be phosphorus (V) oxide, boric oxide or silica sol in the shape of a source compound, preferably in the form of a hydrate, and that is also as components of a heteropoly acid or keggin acid, being added to the component suspension and during the firing process being released again in situ; elementary amorphous boron may be further added at a concentration of approximately 0.1 to 1% being added by the compound as a source compound for boric oxide, whereby it is transformed in situ into boric oxide during the firing process in the remnant atmosphere of the technical vacuum.

The ceramic compound suspension liquid according to the present invention may be selected from glycerine, a glycol, pinacol or an aqueous solution of polyvinylpyrrolidone, of a polyglycol of a lower polymer methacrylic acid amide or a mixture of these substances being added to the aqueous suspension as a stabilizer in such a quantity that the concentration of the stabilizer in the suspension amounts to between 1 and approximately 5% by weight.

The suspension liquid may further be characterized by a cation-active wetting agent being added at a quantity of approximately 0.01 to 0.1% by weight to the aqueous suspension, wherein the compound is applied manually by application with the brush or by spray or polishing process or by rolling, immersion with or without the aid of electrophoresis or by the pressure process, for example, by screen printing. The interlayer is additionally applied to areas especially endangered by bonding of one primary piece surface isolated in accordance with another technical gauge.

The common casting-on structure is released after the casting of the secondary piece by cooling of the one partner with pressurized steam while the other partner is heated, and after separation, the interlayer is removed by blasting with corundum.

The proposed process for producing a casting from a primary piece and a secondary piece using the casting-on technique is characterized by the formation on the surface of the primary piece of a thin ceramic interlayer which serves to isolate against the melt of the secondary piece to be cast, and which is again removed after the secondary piece has been cast and after the primary and secondary pieces have been separated.

The interlayer provided according to invention can be produced by heating to temperature of ca 500°–1200° C. (termed "firing" or "sintering" hereinafter); it does not melt during the casting-on of the secondary piece. Moreover it is itself not alloyable with the primary piece or the secondary piece. A further advantage lies in the proposed interlayer not being transformed into a meltable or alloyable substance under the chemical, and especially the reducing influence of the secondary alloy.

With regard to the isolation procedures pertaining to the state of the art in the casting-ion technique the recipes and process methods disclosed here make possible a good separation of practically all alloys used for precision casting in the field of dentistry, jewellery and precision mechanics.

Isolation is achieved by means of a temporarily applied coating in order that the alloys used can remain free of such constituents, which, as with beryllium, although they make them suitable for the casting-on process, still would exclude them from many applications, especially medical ones.

The interlayers disclosed free the user of the casting-on technique from the necessity of adjusting the composition of his alloys using this casting process and having to accept certain disadvantages (especially relating to chemical corrosion) and allow him to select the interlayers appropriate to the alloy concerned. Moreover the wide context of sintering conditions as well as the mechanical modes of application permit working at reasonable cost of even extensive primary parts which for example would otherwise have been coated using the CVD process only at very great expense.

The compound used according to invention to produce the ceramic interlayer is formed from the physical point of view from a particle-like component which is cemented or sintered by a further non-particle-like component.

The ceramic interlayer is preferably made from a compound which contains a) at least an alkaline-earth metal oxide, a rare earth metal oxide, aluminium oxide or a titanium group metal oxide, or b) at least a metal double oxide or a mixed oxide consisting of at least one metal oxide and also a non-metallic oxide from the elements boron, phosphorus or silicon and/or one halogen compound, especially a fluorine compound, which correspond to the non-metallic oxide. Instead of or in addition to components a) or b) the compound preferably contains: c) red iron(III) oxide at a concentration of 0.1–1.0% Wt, and/or d) a nitride of an element of the titanium metal, vanadium metal and chromium metal group or aluminium borium or silicon nitride, pyrogenous silicon dioxide or silicon carbide.

Within the context of the present invention by 'titan group metal' titanium, zirconium or hafnium should be understood, and by 'vanadium group metal' vanadium, niobium or tantalum, and by 'chromium group metal' chromium, molybdenum and tungsten. One preferred metallic oxide of a metal from the titanium group is zirconium dioxide.

Another suitable oxide, with a limited scope of application due to its radioactivity, is thorium dioxide.

Suitable double oxides b) within the intent of the invention are those double oxides and the anhydrous formal metallic salts of the metal acids and their halogen derivates, or those formal, mixed anhydrides of the metallic acids, in which at least one of the two metal atoms belongs to those listed in a). Examples: cobalt aluminate, or nickel lanthanate, magnesium molybdenate, barium tungstate, magnesium zirconate, barium titanate. The usual and also the inverse spinels are thus typical representatives of the compound classes intended according to invention.

According to invention there belong to the mixed oxides b) those formed from oxides of the elements borium, silicon and phosphorus, as well as the double oxides formed with the metallic oxides a), for example $HfO_2 \cdot SiO_2$, hafnium silicate.

After firing the interlayer has a thickness of 1 μm to 50 μm, preferably 1–8 μm, particularly 2–5 μm. As firing temperatures temperatures of 500°–1200° C., preferably 700°–1100° C., particularly 800°–1000° C. are suitable.

In the present description and patent claims the systematics usual in mineralogy for double and mixed oxides are deliberately used, also for those metal salts which do not actually derive from the hypothetical acids. This has been done on the one hand to ensure unified systematics, and on the other the systematic classification of, for example, cobalt aluminate as a double oxide $CoO. Al_2O_3$ is intended to state that we are here referring not to chemical reactions in an aqueous environment but rather high-temperature chemical reactions in a water-free environment.

The components named occur within the layer as particles with a size of from less than 1 μm to approximately 3 μm. They are to be found sintered, vitrified or compacted in the porcelain interlayer by substances referred to here, generally and without taking the elementary mechanism of the effect into consideration, as 'sintering aids.'

The following occur in the interlayer as sintering aids:

Boron oxide, silicon(IV) dioxide - xerogel, and phosphorus(V) oxide as metal-free sintering aids which during the firing process are released from their source compounds in situ, as well as metalliferous sintering aids in the shape of double oxides of the alkali metal oxides with metal oxides of the titanium and vanadium group, as well as aluminium, molybdenum and tungsten.

Formally these are the salts, or the anhydrides of partially hypothetical metallic acids, whose formal anions do also participate in the formation of the particle phase; they have however particle functions only in connection with a formal cation which is at least bivalent (e.g.: Mg—; Al—; La—; Ti—; Nb—).

As metalliferous sintering aids the formal salts, or anhydrides of the metallic acids, and namely their complex halogen derivates too, once more make an appearance, but now in combination with a univalent formal cation, namely an alkali metal, preferably potassium.

This circumstance derives from the fact that the double oxides of the particle phase for themselves alone do not permit of being sintered directly onto most of the alloys which come into consideration for the casting-on technique. This would however be possible too by adding an alkaline metal hydroxide and a subsequent conversion during the sintering process, but the direct adding of the alkaline metal double oxide as a sintering aid is considerably more practicable, particularly where halogen derivates of the hexafluoroaluminates type, for example, are concerned.

Particle components, such as metalliferous sintering aids also, are suspended together in a liquid, preferably water, which as a protection against too rapid drying contains hydrophilous or hygroscopic substances, such as glycerine, glycol, pinacol and polymer hydrophilic substances used for stabilization, such as polyvinylpyrrolidone, lower polymeric methacrylic acid amide and a cationic wetting agent.

The source compounds for phosphorus(V) oxide are also added to the aqueous suspension substrate, as also silicon dioxide xerogel.

Besides ortho-phosphoric acid and alkali phosphate and alkali silicate solutions, silica sol, boric acid solution and also the corresponding heteropoly acids containing silicon and also phosphorus or boron or keggin acids of the auxiliary group metals are also used as source compounds.

When boric oxide is used as the sole sintering aid the boric oxide is released in situ during the sintering process alternatively from the amorphous, elementary boron, which is added at approximately 0.5–1.0% of the particle phase. The remaining atmosphere which is usually present in the technical vacuum is in a position to effect this conversion.

The overview just given applies to the casting-on technique with casting alloys on a cobalt, chromium, gold, nickel, palladium and silver basis. They resist the reductive attack of the elements silicon and boron which are often found in these alloys and their intermetallic phases. These are at the same time the alloy-bound fluxes which are the most widely found of all. Interlayers which are active with regard to boron and silicon are only really active with regard to carbon and its C phases.

A further addition to an interlayer for the casting-on technique which has favourable effect is red iron oxide $Fe_2O_3$ at a concentration of 0.1–1%, when a secondary alloy with a solidus temperature of above approximately 800° C. is to be cast. The red iron oxide at higher temperatures gives up part of its oxygen content independantly too of the presence of a suitable acceptor and is transformed into the considerably more stable black iron oxide $Fe_3O_4$ which has adequate thermal stability during work with nickel- and cobalt-based alloys. The oxygen being liberated does not only buffer off the effect of boron and silicon but also leads to the formation of an oxide skin on the secondary alloy, Which has for its part a separating effect.

Thus the red iron oxide represents a primarily chemically effective interlayer for the casting-on technique. It is further effective as a sintering aid. The firing time for the interlayer must be limited to approximately 3 min, and the temperature to approximately 900° C., when iron oxide is a participant. The important and advantageous difference from other oxides which split off oxygen, such as chromium oxide and others, lies in the fact that the primary, particulary easily running release of oxygen does not go hand in hand with the release of metallic alloyable and thus damaging foreign metals, but rather the lower black iron(II/III) oxide is formed first, and this is characterized by particular stability in comparison with the red oxide. Experience shows that the reduction capacity present in the brief reaction time available during casting onto the interface of the hardening alloy at the primary piece is too weak to cause a liberation of metallic iron.

Used by itself, that is, not only as a tiny quantitative addition to other interlayers, red iron oxide does not appear certain enough for use at the present state of the art, since an overstrong release of oxygen may produce bubbles in the secondary casting.

The components from which the interlayer is formed are present in part as a fraction of the particles with a size of from less than 1 μm to approximately 2 μm, which are bound by means of a sintering aid to a layer of up to approximately 5 μm thick adhering to the primary piece.

The particle-like components, especially the metal oxide, the metal double oxide and the mixed oxide must be adequately resistant to reduction.

The layer which is formed from the particle phase and the sintering aid can be removed after casting on and after the casting-on structures have been taken apart.

Within the scope of the invention all castable metals and their mixtures up to a solidus temperature of approximately 1600° C. can be used as alloys. Special preference is given to low- and high-melting gold alloys, as also to silver and palladium base alloys, and dental alloys free of noble metals. Primary and secondary pieces can be made of different metals or alloys, whereby silicon is to be treated as a metal within the intention of this invention, provided that we are dealing with primary pieces made from silicon.

Although dental replacement pieces among other things are provided on a temporary basis with the disclosed interlayer, in order that the defined precision casting process of the casting-on technique can be applied to these dental replacement pieces, in the case of the disclosed interlayer we are also concerned from the chemical point of view with a ceramic substance. All the same it would be factually inappropriate and impermissible to refer to or classify the interlayer as 'dental ceramic':

The technical gauge of dental ceramic means a long-lasting coating which is bound to a dental therapeutic medium and which is aesthetically formed and coloured with an anatomical correspondance to the form of the tooth, and which is 200 to 2000 times thicker than the interlayer here referred to. Furthermore the dental ceramic has absolutely no functional connection with a technical gauge for a casting process. Last but not least dental ceramic coatings are characterized by intentionally forming a particularly strong and intimate bond with metals, the metal-ceramic bond.

This characteristic is also in contradiction to the technical gauge, for the essential quality of the interlayers disclosed here is its capability of isolating with respect to molten metals.

In accordance with a preferred mode of execution the process according to invention is used to produce a dental prothetic attachment anchor, in particular a conical or telescopic crown or a lock from a dental casting alloy, in particular a gold alloy, whereby an interlayer is formed from a zirconium dioxide ceramic which is modified according to the working temperature by means of sintering aids. The active component of the ceramic compound is zirconium dioxide $ZrO_2$, to which silica sol is added as sintering aids and in the form of a low temperature version of the execution vanadium(V) oxide $V_2O_5$ and lithium fluoride LiF are added as adhesive and flux agents.

In this form of execution a thin ceramic layer containing zirconium dioxide which isolates against the molten metal of the secondary casting is sintered onto the surface of the primary piece.

Zirconium dioxide cannot be wetted by many liquid metals. It is for this reason especially suitable for building up the isolating layer. The high melting point of over 2700° C. makes however direct melting or sintering onto the primary pieces of the gold casting alloys impossible. Some of the dental gold casting alloys have their solidus point actually in the 850° C. range, most of those not suitable for 'firing-on porcelain' at 900°–950° C., while the so-called 'firing-on alloys' lie between 1000° and 1100° C. Thus a bonding agent is required which can even at such low temperature fix the zirconium dioxide with adequate reliability onto the primary pieces. Here a high- or low-temperature process is to be distinguished by the solidus point of the primary alloy.

$ZrO_2$, High-Temperature Method (Solidus Point above 1000° C.)

When zirconium dioxide powder with a grain size of 1–3 μm (Messrs Ventron) is suspended in aqueous silica sol, this mixture forms even when drying out below room temperature coatings which are very resistant to scratching and the effects of water. When applied to a prepared gold base after drying and fired at 900° C. for about 5 min (a vacuum is appropriate but not a condition) the zirconium dioxide-silica sol mixture sinters together to a translucent layer of approximately one to a few micrometers in thickness, which binds to the autogenous oxides of the alloy, adheres very firmly, is not easily damageable during subsequent working procedures, is stable until far beyond the necessary working temperature, and isolates well against the secondary cast. Since its power of adhesion to bare metal is unsatisfactory, before the coating is applied the smooth surface of the metal must be roughed using a microcorundium blasting agent of approximately 25 μm at low air pressure (2 bar) until the surface appears to the naked eye as perceptibly roughened. On no account should the surface roughness be as deep as with other methods. Blasting agent remnants should be removed by blowing with pressurized steam at approximately 140° C., with a subsequent ultrasonic bath in distilled water at 70° C. for 5 min, after which once more steam is briefly applied. The zirconium dioxide suspension must be applied very sparingly, as a veneer, so that the base beneath it shows through. The application must not run and form puddles; formations which the brush or spray process may leave behind should be spread out immediately by means of the vibration of a precision riffle instrument. Once coatings have dried out they cannot be softened again by dampening and can only be removed by blasting or steaming. Firing takes place after the application appears to the eye to have dried out, and after it has cooled the primary piece is, as normal, worked on further.

ZrO2, Low-Temperature Method

If the primary piece is also to be cast using an alloy with a solidus temperature near or below 900° C., then the firing temperature of the isolation compound must be lowered still further: the zirconium dioxide is sintered with silicic acid with the addition of a liquid phase of vanadium(V) oxide and lithium fluoride. The low melting point of this compound, 690° C. (V2O5) and 842° C. (LiF), and the still lower one of their mixture, permits its use as a flux. Additions of 5% (mass) in each case to the zirconium dioxide are adequate to make sintering possible at a temperature of 750° C. Thus the building up of the ceramic system corresponds to the methods often used in ceramic praxis, the zirconium dioxide, which is as such bad to work with, being sintered under addition of silicates and an aqueous phase. Vanadium(V) oxide is here selected as an aqueous phase as on the one hand it is a good bonding agent for the fired-on ceramic, and on the other it releases part of its oxygen on being heated and thereby partially changes into lower oxides with considerably higher melting points (just below 2000° C.). This feature permits the softening temperature of the isolating sinter layer to rise also, which thus prevents a ceramic sticking together of the primary and secondary pieces.

After casting-on, the attachment, which has been cleaned externally, is heated and quenched in water, or in the case of conical and telescopic crowns the outer crown is quickly heated while the inner crown is cooled in order to separate the casts from one another. The separation itself is done with the aid of the pneumatic chisel. Double crowns which are in contact over large areas of friction and adhesion may despite a perfect separation of the pieces from one another still stick so tightly to one another that the impact pulses of the chisel are not adequate with the tiny inner crown mass to separate them mechanically. Before another attempt at separating them the inner crown is then cast with easily fusible metal (e.g. WOOD's metal) to expand its mass, and the resulting casting is glued into the inner crown with 'instant glue', or a noble metal solder of contrasting colour and low melting point is soldered into the inner crown as an aid for removing it. Once the attachment has been separated then this is soldered out again; the solder remnants are removed using the spot blaster under visual inspection.

An important precondition of the separability of telescopic crowns and similar structures lies in the secondary alloy possessing a lower heat contraction than the primary alloy. The outer crown experiences a greater loss in volume than the inner crown during hardening and cooling as a result of the phase jump from liquid to solid, so that if the same alloy for example is used for the primary and the secondary crown this may lead to insoluble jamming as a result of contraction. In the case of casting into existing hollow moulds contraction behaviour is reversed and should be taken into account accordingly. Furthermore the melting intervals of primary and secondary alloys should whenever possible not overlap, otherwise there is the danger that the inner crown may soften and roughen, and thereby the partners micro-jam to one another and either cannot be separated at all or only with a loss of precision. For final processing the isolation layer is gently blasted with 25 μm corundum powder and polished only with a felt disc and diamond paste.

This method as well as the ceramic isolation compound containing zirconium dioxide are specially geared to the dental prothetic casting-on process using gold alloys. Basically the high temperature version can also be used with success with palladium and nickel as well as cobalt base alloys.

In the case of cobalt and nickel base alloys the zirconium dioxide isolation allows even the technical laboratory with a low level of equipment a routinely reliable casting-on technique with a precision which approaches very closely that of the doping method, as the isolation, coating applied using the zirconium dioxide ceramic process is very much thinner in comparison to the PAC method (Precision Attachment Casting-on technique). Coating thickness of only 10–20% of the usual PAC application thicknesses are necessary. In the case of gold casting alloys which cannot be doped using foreign metals, the zirconium dioxide ceramic process of the casting-on technique is thus at present the method which works the most accurately. This is particularly in comparison with the indirect production method for attachments and locks. The friction aids which give rise to otherwise normal expenses can be dispensed with. A further important advantage over the PAC technique is the problem-free manipulation of the zirconium dioxide porcelain. Such sinter coatings are completely insensitive to handling and considerably scratchproof. As yet there have been no cases of spalling during the secondary casting. Separability and removal after casting are considerably better.

Preferred forms of execution, which are optional however, are described in the following examples:

Preparation of the Primary Piece

To improve the bonding capability of the interlayer, blast the surface with 25 μm corundum blasting agent at 2.5–3 bar pressure until an even, just visible delustering occurs. Then clean in an ultrasonic bath at 70° C. for 10 min with distilled water and steam off with pressured high-temperature steam. This preparation is the same for all interlayer applications.

EXAMPLE 1

Especially favoured form of execution of an interlayer with a single particle-like oxide in accordance with the present invention.

Titanium dioxide with a grain size as small as possible (2–2 μm) is suspended with 0.1% red iron oxide in 50% aqueous orthophosphoric acid, which contains ca 5% glycol, and applied evenly to the primary piece surface in a quantity just enough to cover it using brush, immersion, spray or pressure process.

After the coating has dried sintering under vacuum follows at approximately 900° C. for 3 min in for example a dental ceramic furnace.

The primary piece when cool shows a scratchproof coating yellow when warm and soft pink at room temperature, and modelling of the secondary piece takes place upon this. Suitable for gold, palladium and cobalt as well as nickel base alloys, which may contain boron at up to approximately 2%, silicon at up to approximately 2%, carbon in any quantity usual for alloys, as well as phases containing nitrogen. Very large quantities of boron (around 3%) may colour the coating purple and blue in those parts which are most strongly stressed by heat, but without adversely affecting its properties of isolation.

EXAMPLE 2

Especially favoured form of execution of an interlayer with a double oxide in accordance with the present invention:

Cobalt aluminate with a grain size as small as possible (1–2 μm) is suspended with commercially available silica sol (containing approximately 60% silicic acid) diluted at 1:1, and approximately 5% glycerine is added to the suspension, which is applied evenly to the primary piece. After drying it is fired under vacuum in the ceramic furnace at 1000° C. for 10 min and is then processed further as above. This coating is deep blue.

Especially suited for gold base alloys. The separation effect is so great that it still remains even if the primary piece becomes deformed as the result of extreme overheating.

EXAMPLE 3

Especially favoured form of execution of an interlayer with a mixed oxide in accordance with the present invention:

Magnesium zirconate with a grain size as small as possible (1–2 μm) is suspended with 0.1% red iron oxide in 30% tungsten silicic acid with the addition of 1% polyvinylpyrrolidone and applied evenly to the primary piece in a quantity just enough to cover it. The polyvinylpyrrolidone is taken from a correspondingly concentrated main solution, since some time is required for complete dissolution. After vacuum firing at 1000° C., as described above, a lemon-yellow interlayer is obtained which can take on the reversible blue colouring of the lower tungsten oxides when in contact with reducing agents in the presence of heat, for example when put into the flame of the bunsen burner. Suitable for palladium and cobalt base alloys.

EXAMPLE 4

Especially favoured form of execution of an interlayer with a aluminium nitride in accordance with the present invention:

Aluminium nitride is suspended with boric phosphate and aluminium phosphate with a grain size as small as possible and in equal proportions in 30% molybdophosphoric acid, and applied to the primary piece, and then after drying fired under vacuum at 1000° C. as described above. A light grey, adhesive coating is produced on the primary piece which reacts in a similar manner to coatings containing tungsten to reducing agents in the presence of heat by taking on a reversible blue coloration.

Suitable for low-melting gold, copper, silver base alloys; for alloys with a high content of phases containing phosphides.

EXAMPLE 5

Especially favoured forms of execution of an interlayer for alloys with a melting point range from 450° to approximately 700° C.:

Suspend hafnium dioxide in 50% silica sol containing 3% glycerine and then the coating, which should be applied in a quantity just enough to cover it, should be heated after drying only up to approximately 300° C. Then casting onto the scratchproof interlayer, which by this stage is bonded by a silica sol xerogel; the interlayer, although it has not been properly 'fired', is now no longer water-soluble and must be blasted off.

EXAMPLE 6

Examples of the composition of an interlayer with a sintering aid from the group of alkali metal/titanium metal double oxides or their complex halogen derivates:

Hafnium dioxide 90–95%; potassium hexafluorotitanate 2–5%; potassium hexafluoroaluminate-potassium tetrafluoroaluminate 2–5%. As a mixed powder suspended, for example, in polyvinylpyrrolidone solution, 1% in water, can be sprayed or applied with the brush at the approximate consistency of thin paint. After drying, fire under vacuum at 1000° C. for 10 min.

Result: a white solid interlayer for high-melting alloys with high proportions of silicon and boron (upto approximately 3%).

After the casting-on structure have been removed the pieces are first separated from one another by pressurized steam being blown onto the piece with the patrix function to cool it, while the matrix is strongly and briefly heated. Successful separation of the pieces can be recognized by the different colours when incandescent which indicates the interruption of heat conductance between the two. Separation is effected using the pneumatic chisel in the manner the specialist is acquainted with.

I claim:

1. Process for the production of a casting consisting of a primary piece and a secondary piece using the casting-on technique, comprising the steps of:

a) placing a thin layer of a sinterable ceramic composition on the surface of the primary piece, b) sintering the ceramic composition to form a thin ceramic interlayer on the surface of the primary piece, such that the interlayer isolates the primary piece against the secondary piece, c) casting the secondary piece, which is a metal melt, on the interlayer formed on the primary piece, d) separating the primary and secondary pieces, and e) removing the interlayer from the surface of the primary piece.

2. The process of claim 1, wherein the ceramic interlayer is formed from components of a ceramic compound which is applied to the primary piece, and fired to a homogeneous coating at a temperature between 500° and 1200° C.

3. The process of claim 2 wherein the ceramic compound is suspended or dissolved in an aqueous liquid before being applied to the primary piece.

4. The process of claim 2 wherein the interlayer has a thickness after firing of 1 to 50 μm.

5. The process of claim 4, such that any one of the following is produced: a dental prosthetic attachment anchor, a conical crown, a telescopic crown, or a lock of dental alloy.

6. The process in accordance with claim 5, wherein the ceramic interlayer is made of a compound which contains:

a) at least one alkaline-earth metal oxide, a rare earth metal oxide, aluminium oxide or a titanium group metal oxide, or b) at least one metal double oxide or a mixed oxide consisting of at least one metal oxide as well as one non-metallic oxide from the elements boron, phosphorus or silicon and/or one halogen, especially a fluorine compound corresponding to the non-metallic oxide.

7. The process of claim 6, wherein the compound further contains:

c) red iron (III) oxide at a concentration of 0.1–1.0% Wt, and/or d) a nitride of one metal from the titanium metal, vanadium metal and chromium metal group or aluminium boron silicon nitride, pyrogenous silicon dioxide or silicon carbide.

8. The process of claim 6 wherein the interlayer comprises zirconium dioxide.

9. The process of claim 8, wherein zirconium dioxide is suspended in aqueous silica sol, and further comprising sintering aids, dependent on working temperatures.

10. The process of claim 9, wherein the zirconium dioxide-silica sol suspension is fired, after drying onto the surface of the primary piece, at a temperature of between 900° to 950° C.

11. The process of claim 9, wherein the zirconium dioxide further comprises 5% Wt lithium fluoride as flux agent and 5% Wt vanadium (V) oxide as a bonding and flux agent.

12. The process of claim 11, wherein the zirconium dioxide lithium fluoride and vanadium (V) oxide are suspended in aqueous silica sol, which is applied to the surface of the primary piece, and, after drying, fired at a temperature of 700° to 750° C.

13. The process of claim 6 or 7, wherein the compound is made of:

e) 90–98% Wt high-melting particles having a softening temperature which is greater than the sintering temperature of the compound, and f) approximately 2–10% Wt low-melting particles which soften at a temperature which is less than or equal to the sintering temperature and which are soluble in water without being hygroscopic, and, optionally, g) a sintering aid for the high-melting particles, selected from the group silicic acid as xerogel, boric oxide and phosphorus (V) oxide, such that these sintering agents are released from source compounds in situ during the firing process.

14. The process of claim 13, wherein at least one of components (a), (b), and/or (d) are used as high-melting particles.

15. The process of claim 14, where a double oxide or a mixed oxide as in (b) is used, wherein component (b) is stoichiometrically defined and is a formal anhydrous salt of silicic phosphoric boric or a metallic acid or a formal mixed anhydride of different metallic acids, including halogen-free heteropoly acids and keggin acids of the auxiliary metal group, whereby at least one of the metallic central atoms in the compounds named and/or the formal cation is an alkaline-earth metal, a rare earth metal, aluminium or a titanium group metal.

16. The process of claim 15, wherein component (b) is used as a low-melting particle, which is stoichiometrically defined and corresponds formally to an anhydrous salt of silicic phosphoric boric or a metallic acid, including halogen-free heteropoly acids and keggin acids of the auxiliary metal group, whereby within the formal anion the oxygen can be replaced by a halogen, preferably fluorine, the formal cation, however, being exclusively an alkaline metal, in particular, potassium.

17. The process of claim 13, such that the sintering aids phosphorus (V) oxide, boric oxide or silica sol in the shape of a source compound, preferably in the form of a hydrate, and that is also as components of a heteropoly acid or keggin acid, being added to the component suspension and during the firing process being released again in situ.

18. The process of claim 17, wherein elementary amorphous boron at a concentration of approximately 0.1 to 1% is added to the compound as a source compound for boric oxide, whereby it is transformed in situ to boric oxide during the firing process.

19. The process of claim 3, wherein glycerine, a glycol, pinacol or an aqueous solution of polyvinylpyrrolidone, of a polyglycol, of a lower polymer methacrylic acid amide or a mixture of these substances is added to the aqueous suspension as a stabilizer in such a quantity that the concentration of the stabilizer in the suspension amounts to between 1 and approximately 5% Wt.

20. The process of claim 19, wherein a cation-active wetting agent is added at a quantity of approximately 0.01 to 0.01% Wt to the aqueous suspension.

21. The process of claim 20, wherein the compound is applied manually by application with a brush or by spray or polishing process or by rolling, immersion with or without the aid of electrophoresis or by a pressure process, or by screen printing.

22. The process of claim 21, wherein the interlayer is additionally applied to areas especially endangered by bonding of one primary piece surface isolated in accordance with another technical gauge.

23. The process of claim 22, wherein the primary and secondary pieces are released after the casting of the secondary piece by cooling of one piece with pressurized steam while the other piece is heated, and, after separation, the interlayer is removed by blasting with corundum.

24. The process of claim 6, wherein the secondary piece is cast from a dental alloy whose liquidus point is as close as possible to or below the solidus point of the alloy of the primary piece.

25. The process of claim 2, wherein the component of the ceramic compound is fired at a temperature between 800° and 1000° C.

* * * * *